United States Patent [19]

Stewart

[11] Patent Number: 4,679,390

[45] Date of Patent: Jul. 14, 1987

[54] OPENING ROLLER ASSEMBLIES FOR OPEN END SPINNING MACHINES

[75] Inventor: William R. Stewart, Strathmartine, Scotland

[73] Assignee: Wm. R. Stewart & Sons (Hacklemakers) Limited, Scotland

[21] Appl. No.: 831,437

[22] Filed: Feb. 20, 1986

[30] Foreign Application Priority Data

Feb. 22, 1985 [GB] United Kingdom ..... 8504595

[51] Int. Cl.[4] ..... D01H 7/895

[52] U.S. Cl. ..... 57/408; 19/97; 19/112; 29/110; 57/406; 57/407; 57/411

[58] Field of Search ..... 57/408–412, 57/406, 407; 19/97, 98, 105, 112, 272; 29/110, 116, 123, 125, 129, 129.5, 132

[56] References Cited

U.S. PATENT DOCUMENTS

| | | | |
|---|---|---|---|
| 2,133,657 | 10/1938 | Devaux | 19/272 |
| 2,178,627 | 11/1939 | Devaux | 19/272 |
| 2,686,940 | 8/1954 | Burnham | 19/272 |
| 2,855,786 | 8/1958 | Spodig | 19/272 X |
| 3,079,646 | 3/1963 | Burnham | 19/272 |
| 3,149,403 | 9/1964 | Aurich et al. | 29/129.5 |
| 3,150,419 | 9/1964 | Aurich | 29/110 X |
| 3,168,760 | 2/1965 | Olcott | 29/110 X |
| 3,221,389 | 12/1965 | Cowell | 29/116 |
| 4,296,527 | 10/1981 | Eadie | 19/112 |
| 4,300,265 | 11/1981 | Heinen | 19/112 |
| 4,435,953 | 3/1984 | Schmid et al. | 57/408 |
| 4,574,583 | 3/1986 | Stahlecker et al. | 57/408 |

*Primary Examiner*—John Petrakes

*Attorney, Agent, or Firm*—Cushman, Darby & Cushman

[57] ABSTRACT

An opening roller assembly for open end spinning machines wherein the roller is releasably and slidably supported on a drive shaft of the open end spinning machine to enable easy removal of the roller for refurbishing, replacement or repair. Non-mechanical means is provided to maintain the roller in an operative position on the drive shaft. Such means may comprise magnetic or fluid pressure means, or gravity. When in its operative position on the shaft, mechanical drive means extending directly or indirectly between the drive shaft and the roller will automatically become engaged. These drive means may be provided by a drive pin or mating engaging surfaces, for example.

13 Claims, 7 Drawing Figures

OPENING ROLLER ASSEMBLIES FOR OPEN END SPINNING MACHINES

This invention relates to opening roller assemblies for open end spinning machines. In an open end spinning process the opening rollers which separate the fibres are each carried on a short drive shaft which is supported by one or more bearings mounted in a spinning box. Each roller is pinned or is wrapped with flexible saw-toothed wire and is generally contained in a recess in the spinning box which in turn is closed by a suitable lid or cover plate. There is only a small clearance between the peripheral surfaces of each opening roller and the walls of the recess in which it is fitted. Thus, once the cover plate is fixed in position the opening roller could only move axially by very small amounts even if it were not constrained by the shaft to which it is secured.

In the past, each opening roller has always been immovably secured to its shaft by means of a mechanical interlock, such as screws, adhesive, locking jaws, screw threads, a press fit or some other positive means. Thus, when it becomes necessary to change an opening roller due, for example, to pin wear, it has always been necessary to slacken screws, break an adhesive bond, release locking jaws, undo screw threads, or force off under pressure the roller and usually this requires complete removal of the shaft and opening roller assembly from the spinning box. As there are usually at least about 100 opening rollers per open end spinning machine, changing of rollers is a very time-consuming and labour intensive operation and has a significant effect on the total down-time of the open end spinning machine.

It is an object of the present invention to overcome the problems mentioned above and to provide an opening roller assembly for an open end spinning machine so that each roller can easily and quickly be removed from its drive shaft for replacement or refurbishment purposes.

According to the present invention, we provide an opening roller assembly for an open end spinning machine comprising a drive shaft mounted for rotation in a bearing forming part of or fitted to the machine and an opening roller having a circumferential surface which may be pinned or wrapped with flexible saw-toothed wire, said roller preferably having a boss, and forming a close sliding fit on the drive shaft, wherein at least part of the roller is restrained in the axial direction of the drive shaft in an operating position on the shaft by a non-mechanical force to allow easy removal of at least part of the roller from the shaft and including mechanical drive means for imparting rotation of the shaft to the roller when said roller is in said operative position.

The drive shaft may extend generally vertically, in which case the roller may be held in its operating position by means of gravity.

Preferably, the drive means is supported on and rotatable with the shaft and positively engages with drive means on the roller.

As an alternative to gravity, the restraining non-mechanical force may be provided by magnetic means or fluid pressure operated means or for that matter any other non-mechanical means for holding the roller fully on the drive shaft so that the drive means will become positively engaged.

It is preferred, however, that the drive means comprises a pin engageable in a recess. The pin may be fixedly secured for rotation with the drive shaft, in which case the recess would be on the roller, but an alternative arrangement would be equally suitable. Alternative forms of mating devices may be engageable with each other when the roller is in its operating position to provide said drive means. For example, a flange rotatable with the drive shaft may have one or more radially extending ribs thereon engaging with an opposed recess on a part of the roller.

If the roller has a pinned circumferential surface and the tails of the pins extend inwardly of the roller shell, the outer face of which provides said surface, then a drive pin secured to a radially extending flange secured for rotation with the drive shaft may locate between the tails of some of said pins to provide the drive means.

Several embodiments of opening roller assemblies for open end spinning machines in accordance with the invention are now described by way of example with reference to the accompanying drawings, in which.

Figure 2:
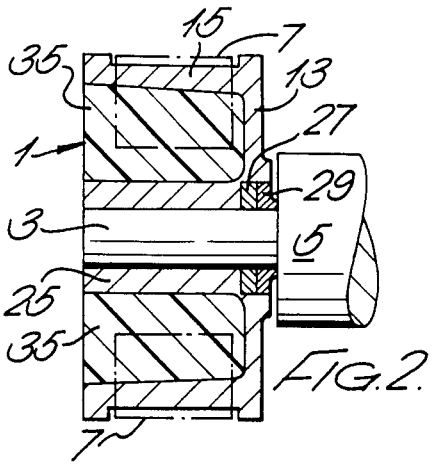
FIGS. 2–4 are similar views of alternative embodiments.
Figure 3:
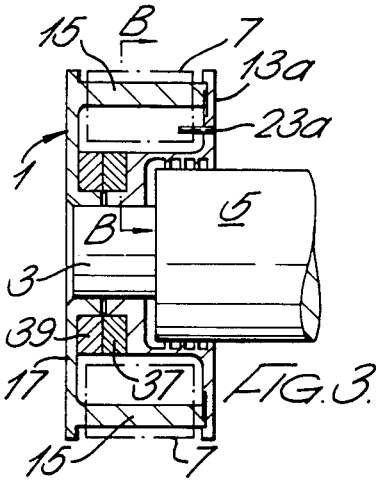
Figure 5:
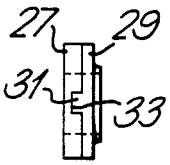
Figure 5A:
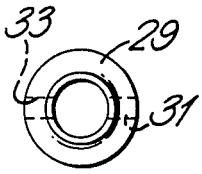
Figure 6:
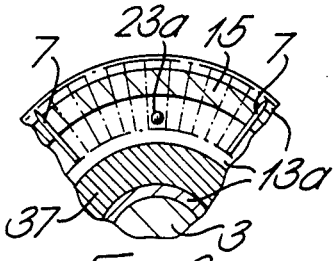

FIGS. 5 and 5*a* are two views showing the drive means in the embodiment of FIG. 2; and FIG. 6 is a scrap sectional view taken on the line B—B in FIG. 3.

In the drawings, like parts are identified with the same reference numbers.

In each of FIGS. 1–4 an opening roller 1 is shown slidably mounted on a drive shaft 3 rotatable about its longitudinal axis in a bearing 5. All the rollers shown are of the pinned type with the pinned area schematically indicated at 7 located between radially projecting flanges 9 bounding a circumferential surface 11 from which the pin tips project. Instead of being pinned, with the pins held in position for example as disclosed in our U.K. Pat. No. 1298561, the circumferential surface 11 may be wrapped with card wire.

Figure 1:
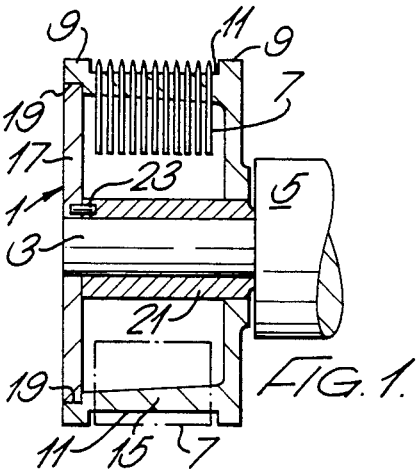
FIG. 1 is a diametral section through the opening roller of a first embodiment.

In the construction shown in FIG. 1, the roller has a first side wall 13 formed integral with a circumferential wall or shell 15, the outer periphery of which provides the two flanges 9 and the pinned surface 11, and a mild steel end cap 17 forming the side wall opposite the side wall 13. The shell 15 and side wall 13 may be formed of diecast aluminium and the end cap 17 is located within a recess 19 and bonded in position. A magnetic sleeve 21 is bonded to the drive shaft 3 and terminates a short distance from the end face of the drive shaft 3, which distance is equal to the thickness of the end cap 17. A central round aperture is formed in the side wall 13 allowing this side wall to be slid onto the sleeve 21 with a close fit, whereas a smaller aperture equal in diameter to the diameter of the shaft 3 is formed in the end cap 17 so that the end of the drive shaft 3 is slidably received in this aperture with the end cap locating against the end face of the sleeve 21. The sleeve 21 is so magnetised that the mild steel end cap 17 is attracted towards the end face of the sleeve so as to hold the roller in its operating position on the sleeve. In order to enable rotational movement of the drive shaft 3 to be imparted to the roller 1, one or more drive pins 23 are provided. As shown, the or each drive pin is fixedly secured in the end face of the magnetic sleeve 21 so that its free end projects therefrom for engagement in a suitable aperture in the internal face of the end cap 17. Alternatively, however, the or each drive pin 23 could be fixedly secured in an aperture in the end cap 17 with its free end being rotatable in a corresponding aperture in the end face of the magnetic sleeve 21.

In the construction shown in FIG. 2, the body of the opening roller is diecast and has an integral end wall 13, circumferential shell 15 and internal boss 25. On the inner face of the end wall 13, a recess is machined into which a mild steel plate 27 is secured, the plate having an internal aperture of a diameter equal to that extending through the boss 25 so that the roller forms a close sliding fit on the drive shaft 3. A disc-like magnet 29 is secured to the drive shaft so that when the roller is located on the drive shaft 3 its plate 27 will be attracted to the magnet 29 to hold the roller in its operative position. In order to impart drive from the shaft 3 to the roller 1, two upstanding radial ribs 31 are provided on the magnet 29 which engage in mating grooves 33 in the plate 27 as is clearly apparent from FIGS. 5 and 5*a*. The ribs and grooves 31 and 33 could of course be switched around so that the former are in the plate 27 and the latter are formed in the magnet 29. In this construction, the tails of the pins are encapsulated with a plastic infill 35.

In the construction shown in FIG. 3, the drive shaft 3 is shorter than in the previous constructions and the opening roller is formed of two parts, a first part of which forms an internal end wall 13*a*, which is preferably formed of brass, and which has a generally stepped construction and is permanently located on the drive shaft 3 with the stepped region partially overlying the bearing 5. The second replaceable part of the roller provides the outer end wall 17 and the shell 15 from which the pins project, the inner part of the shell locating within a circumferential groove in the outer face of the inner end wall 13*a*. A magnetic ring 37 is bonded to the first part incorporating the end wall 13*a*, whereas a mild steel ring 39 is bonded to the second part incorporating the outer end wall 17 which is preferably formed of diecast aluminium. Hence, when the second part of the roller carrying the pins (or card wire) is located on the drive shaft 3, it will be attracted towards the first or fixed part and held in its operative position. Drive to the second part is imparted by means of a drive pin 23*a* secured to the inner end wall 13*a* and engaging within the pin tails of the pins which project inwardly from the shell 15. These pin tails are illustrated schematically in FIG. 6.

Figure 4:
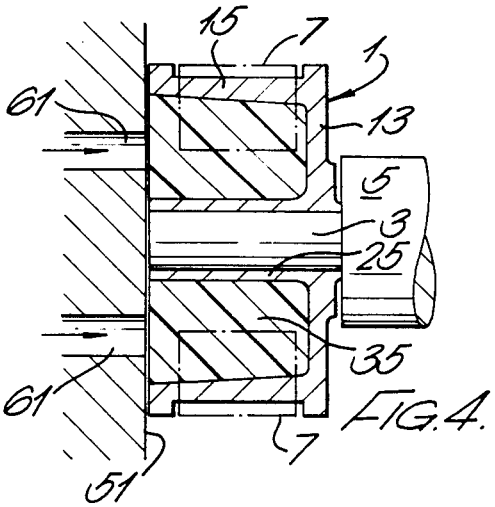

In the construction shown in FIG. 4, the roller 1 is of similar construction to that shown in FIG. 2 with integral internal end wall 13, shell 15 and boss 25 and as before the pins tails are encapsulated in infill 35. In this construction the cavity in which the roller is located when in its operative position on the drive shaft 3 is closed off by a removable cover plate 51 and to maintain the roller in its operative position on the shaft 3, fluid pressure, e.g. air pressure is applied to the outer end face of the roller 1 through one or more apertures 61 in the cover plate 51. Drive from the shaft 3 to the roller 1 can be provided in a similar manner to that for the FIG. 2 construction.

The FIG. 4 construction could be modified in various ways. For example, the drive shaft 3 could be stepped to provide a bearing face for the inner end of the boss 25. Also, the opening roller could be of two-part construction somewhat on the lines of that shown in FIG. 3.

In all the constructions described above, the drive shaft 3 has been shown as extending generally horizontally. This is not an essential requirement, however, and the drive shaft may extend at any other orientation including vertically. If the drive shaft is vertical, then the opening roller could be held in its operative position on the shaft purely by gravity, although it might be advantageous to provide a magnet or fluid pressure to prevent its spinning or vibrating.

From the foregoing, it will be appreciated that the present invention allows either an entire opening roller 1 (or part of the roller) to be slidably supported on a drive shaft 3 of an open end spinning machine, non-mechanical means being provided to maintain it in an operative position, and mechanical drive means being provided extending between the drive shaft 3 or a part thereon and the roller 1 or a part thereon which become engaged when the roller is in its operative position. This therefore allows easy and quick replacement of worn rollers.

It will be appreciated that the various non-mechanical means described for maintaining the roller in its operative position are only illustrative of a few possible arrangements and likewise, the drive means for imparting drive to the roller from the drive shaft 3 are only illustrative of a few of many possible constructions. It should be borne in mind, therefore, that many alternative means would be possible and that those described with reference to one particular Figure of the drawings could in many instances be incorporated in the construction shown in an alternative Figure.

It will of course be understood that the present invention has been described above purely by way of example, and modifications of detail can be made within the scope and spirit of the invention.

I claim:

1. An opening roller assembly for an open end spinning machine comprising a drive shaft mounted for rotation in a bearing forming part of or fitted to the machine and an opening roller having a circumferential surface which may be pinned or wrapped with flexible saw-toothed wire, said roller forming a close sliding fit on the drive shaft, and including a non-mechanical force means restraining at least part of said roller in the axial direction of said drive shaft in an operating position on said shaft to allow easy removal of at least part of said roller from said shaft and further including mechanical drive means to impart rotation of said shaft to said roller when said roller is in said operative position.

2. An assembly according to claim 1 wherein said drive means is supported on, and rotatable with, the shaft, and positively engages with drive means on said roller.

3. An assembly according to claim 1 wherein said shaft extends vertically and gravity holds said roller on said shaft.

4. An assembly according to claim 1 wherein said non-mechanical force means to hold said roller in an operating position comprises magnetic means.

5. An assembly according to claim 1 wherein said non-mechanical force means to hold said roller in an operating position comprises fluid pressure operated means.

6. An assembly according to claim 1 wherein said drive means comprises a pin engageable in a recess.

7. An assembly according to claim 6 wherein said pin is fixedly secured for rotation with said drive shaft and said recess is in said roller.

8. An assembly according to claim 1 wherein said drive means comprises a flange rotatable with said drive shaft, and wherein the surface of said flange and a face of said roller are provided with at least one mating projection and recess to provide said drive means.

9. An assembly according to claim 8 wherein said flange has at least one radially extending rib thereon engaging with an opposed recess on said roller.

10. An assembly according to claim 1 wherein said roller has a shell with a pinned circumferential surface and the tails of said pins extend inwardly of said roller shell, the outer face of which provides said circumferential surface, and wherein a drive pin is secured to a radially extending flange secured for rotation with said drive shaft which locates between the tails of some of said pins to provide said drive means.

11. An opening roller assembly for an open end spinning machine comprising a drive shaft having a free end and mounted for rotation in a bearing forming part of or fitted to the machine, an opening roller having a circumferential portion forming a circumferential surface which may be pinned or wrapped with flexible saw-toothed wire, said roller being coaxially mounted on said shaft with at least said circumferential portion being axially slidable on said shaft; and magnet means secured to one of said shaft and said roller and magnetizable means disposed axially adjacent said magnet means and secured to the other of said shaft and said roller and cooperating with said magnet means to effect a drive connection between said shaft and said roller and to releasably restrain at least said circumferential portion of said roller against axial movement along said shaft whereby said circumferential portion can be removed from said free end of said shaft when desired, by sliding at least said circumferential portion in an axial direction toward said free end of said shaft.

12. An opening roller assembly for an open end spinning machine comprising a drive shaft having a free end and mounted for rotation in a bearing forming part of or fitted to the machine; an opening roller having a circumferential portion forming a circumferential surface which may be pinned or wrapped with flexible saw-toothed wire, said circumferential portion being magnetizable, said roller being coaxially mounted on said shaft with said circumferential portion being axially slidable on said shaft; magnet means secured to said shaft and disposed radially adjacent said magnet means and cooperating with said magnet means to releasably restrain at least said circumferential portion of circumferential portion can be removed from said free end of said said roller against axial movement along said shaft whereby said shaft when desired, by sliding said circumferential portion in an axial direction toward said free end of said shaft; and a releasable mechanical connection between said circumferential portion and said magnet means.

13. An opening roller assembly for an open end spinning machine comprising a drive shaft having a free end and mounted for rotation in a bearing forming part of or fitted to the machine; an opening roller having a circumferential portion forming a circumferential surface which may be pinned or wrapped with flexible saw-toothed wire, said roller being coaxially mounted on said shaft with at least said circumferential portion being axially slidable on said shaft; pneumatic means for applying a gas pressure to at least said circumferential portion in an axial direction to releasably restrain at least said circumferential portion of said roller against axial movement along said shaft in a direction opposite the direction of the fluid pressure, whereby said circumferential portion can be removed from said free end of said shaft when desired, by sliding said circumferential portion in an axial direction toward said free end of said shaft.

* * * * *